US005162859A

United States Patent [19]

Hirono et al.

[11] Patent Number: 5,162,859

[45] Date of Patent: Nov. 10, 1992

[54] IMAGE FORMING APPARATUS CAPABLE OF CREATING DUPLEX MIXED FULL COLOR AND BLACK/WHITE COPIES AND DELIVERING COPY SETS ON PAGE-SEQUENTIAL ORDER

[75] Inventors: Tatsuo Hirono, Kawasaki; Yasunori Kawaishi, Narashino; Nobuo Kasahara, Yokohama, all of Japan

[73] Assignee: Ricoh Company, Ltd., Tokyo, Japan

[21] Appl. No.: 664,941

[22] Filed: Mar. 5, 1991

[30] Foreign Application Priority Data

| | | | |
|---|---|---|---|
| Mar. 5, 1990 | [JP] | Japan | 2-51885 |
| Mar. 29, 1990 | [JP] | Japan | 2-78849 |
| Mar. 30, 1990 | [JP] | Japan | 2-81222 |
| Jun. 29, 1990 | [JP] | Japan | 2-169956 |
| Oct. 12, 1990 | [JP] | Japan | 2-272290 |
| Nov. 29, 1990 | [JP] | Japan | 2-325634 |

[51] Int. Cl.[5] ..... G03G 21/00

[52] U.S. Cl. ..... 355/313; 355/24; 355/319; 355/320; 355/327; 358/75

[58] Field of Search ..... 355/24, 311, 318, 319, 355/320, 326, 327, 328, 309, 313; 358/75; 271/3.1

[56] References Cited

U.S. PATENT DOCUMENTS

| | | | |
|---|---|---|---|
| 4,714,939 | 12/1987 | Ahern et al. | 355/275 |
| 4,934,681 | 6/1990 | Holmes et al. | 355/320 X |
| 5,032,904 | 7/1991 | Murai et al. | 358/75 |
| 5,070,367 | 12/1991 | Sugano et al. | 355/326 |

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

A copier, laser printer or similar image forming apparatus of the type having an intermediate image transfer body in the form of a belt allows documents to be reproduced in a page-sequential paper discharge mode which discharges paper sheets, or recording media, in order of page. When an automatic two-sided copy mode is selected, the apparatus automatically sets up the page-sequential paper discharge mode. Hence, when two sided black-and-white documents and color documents are reproduced together in the automatic two-sided copy mode, paper sheets are driven out of the apparatus in order of page.

8 Claims, 20 Drawing Sheets

100
101
CCD DRIVE
102
CCD
R·G·B
103
ANALOG PROCESS
R·G·B
104
DIGITAL PROCESS
R·G·B
105
106
IMAGE PROCESSOR
107
CLOCK GENERATOR
Y·M·C·B
108
109
WRITE CONTROL
Y·M·C·B
110
LD DRIVE
Y·M·C·B
111(9)
LD

IMAGE FORMING APPARATUS CAPABLE OF CREATING DUPLEX MIXED FULL COLOR AND BLACK/WHITE COPIES AND DELIVERING COPY SETS ON PAGE-SEQUENTIAL ORDER

BACKGROUND OF THE INVENTION

The present invention relates to a copier, laser printer or similar image forming apparatus of the type having an intermediate transfer body in the form of a belt and, more particularly, to an image forming apparatus operable in a page-sequential paper discharge mode which discharges recording media, or paper sheets, in order of page.

An image forming apparatus of the type described is disclosed in Japanese Patent Laid-Open Publication Nos. 209470/1989 to 209472/1989. With this type of apparatus such as a copier, it is a common practice to execute a two-sided copy mode by forming a non-mirror toner image (first image) representative of a first document on a photoconductive element, then transferring the toner image to an intermediate transfer belt, and then forming a mirror toner image (second image) representative of the second document on the photoconductive element. The first and second images so formed on the transfer belt and drum, respectively, are simultaneously transferred to opposite sides of a recording medium or paper sheet. Such a conventional apparatus has various problems left unsolved, as enumerated below.

(1) When black-and-white documents and color documents are stacked together, the image surface and the lead-and-trail orientation of a discharged paper sheet differs depending on the document.

(2) Although a paper reversing means may be used to turn over paper sheets so that their image surfaces may coincide, the paper sheets are sill different in lead-and-trail orientation from one another and, therefore, cannot be arranged in order of page.

(3) Should a toner image representative of a black-and-white document be transferred to the transfer belt in the same manner as a toner image representative of a color document, the productivity (copying rate) would be critically lowered although paper sheets could be discharged in order of page despite the mixture of two different kinds of documents.

(4) While a copier with an automatic document feeder which allows paper sheets to be driven out in order of page is extensively used, such a document feeder is not applicable to a copier of the type using a transfer belt.

(5) When a two-sided document carrying a black-and-white and a color image on opposite sides thereof is used, a paper sheet carrying an image on the first side thereof is stacked in a particular position, depending on the kind of image printed on the second side of the document. Hence, it is necessary to confirm whether the images printed on both sides of documents are black-and-white or color.

(6) The conventional apparatus does not need stacking means for temporarily stacking paper sheets each carrying an image on one side thereof in order to produce a two-sided copy or a composite copy and, therefore, paper transport paths extending to and from the stacking means. The construction is, therefore, simple and miniature while achieving acceptable reliability as to paper jams and other occurrences. However, a plurality of copies cannot be reproduced unless the documents are replaced, resulting in lower productivity compared to the copier with refeedable stacking means.

(7) Paper sheets having undergone copying operation may be rearranged in order of page by hand. However, when a finisher having a punching function or a stapling function, for example, is associated with the copier, such manual rearrangement of paper sheets is a vital problem.

Further, the conventional apparatus taught in previously mentioned Laid-Open Publications each has optics which illuminates a document from both of the leading and trailing edges thereof and focuses the resultant reflection onto a photoconductive element. With this kind of optics, it is impracticable to enhance reproducibility unless a slit having an extremely narrow width is used.

SUMMARY OF THE INVENTION

It is therefore an object of the present invention to provide a copier, laser printer or similar image forming apparatus capable of discharging paper sheets in order of page rapidly in any of various copy modes which are practicable with a mixed stack of black-and-white documents and color documents.

It is another object of the present invention to provide a generally improved image forming apparatus.

An image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, a reversing device for reversing the direction in which a recording medium is discharged in order to execute a page-sequential medium discharge mode, a stacking device for refeedably stacking, in a composite copy mode or a two-sided mode, recording media each carrying an image on a first side thereof, an automatic document feeding device for transporting a recording medium to a predetermined position of illumination defined on a glass platen and having a reversing function for automatically turning over the recording medium, and a control device for selecting the page-sequential medium discharge mode when an automatic two-sided copy mode using the automatic document feeding device is selected.

Also, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, an automatic document feeding device for automatically feeding a document to a predetermined position for illumination defined on a glass platen, and a control device for automatically selecting a page-sequential medium discharge mode when copying using the automatic document feeding means is selected.

Further, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, an automatic document feeding device for transporting a document to a predetermined position for illumination defined on a glass platen, and a control device for automatically selecting a page-sequential medium discharge mode when copying using the automatic document feeding means is selected.

Further, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, a reversing device for reversing the direction in which a recording medium is discharged in order to execute a page-sequential medium discharge mode, an automatic document feeding device for automatically transporting a document to a predetermined position for illumination defined on a glass platen, and a control device for automatically selecting a page-sequential medium discharge mode when copying using the automatic document feeding device is selected.

Further, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, a reversing section for reversing the direction in which a recording medium is discharged in order to execute a page-sequential medium discharge mode, a stacking device for refeedably stacking, in a composite copy mode or a two-sided copy mode, recording media each carrying an image on a first side thereof, and a control device for allowing interrupt copying using a composite copy or a two-sided copy mode to occur when the set number of copies is smaller than the maximum number of images which can be formed on the transfer belt.

Moreover, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, a reversing device for reversing the direction in which a recording medium is discharged in order to execute a page-sequential medium discharge mode, a stacking device for refeedably stacking, in a composite copy mode or a two-sided mode, recording media each carrying an image on a first side thereof, and a control device for forming, when a composite copy mode or a two-sided copy mode is selected and if the set number of copies is smaller than the maximum number of copies which can be formed on the transfer belt, the set number of images of the first side on the transfer belt to execute the composite copy mode or the two-sided copy mode.

Yet, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, and a control section for setting up a page-sequential medium discharge mode when a mixed stack of black-and-white and color documents are to be reproduced, as desired.

In addition, yet, an image forming apparatus of the present invention comprises an image reading device for selectively reading a document in either one of opposite directions with respect to the leading and trailing edges of the document while automatically distinguishing a black-and-white document and a color document, a writing device for selectively forming either one of a mirror and a non-mirror electrostatic latent image on a photoconductive element, developing means for developing the latent image formed on the photoconductive drum to produce a toner image, a transfer belt located to face the photoconductive element and to allow a recording medium to pass through between the transfer belt and the photoconductive element, a first transferring device for transferring a mirror toner image from the photoconductive element to a recording medium and a non-mirror toner image from the photoconductive element to the transfer belt, a second transferring device for transferring the toner image from the transfer belt to a recording medium, a reversing device for reversing the direction in which recording medium should be discharged, and a control device for setting up a page-sequential medium discharge mode when a mixed stack of black-and-white documents and color documents are to be reproduced, as desired.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
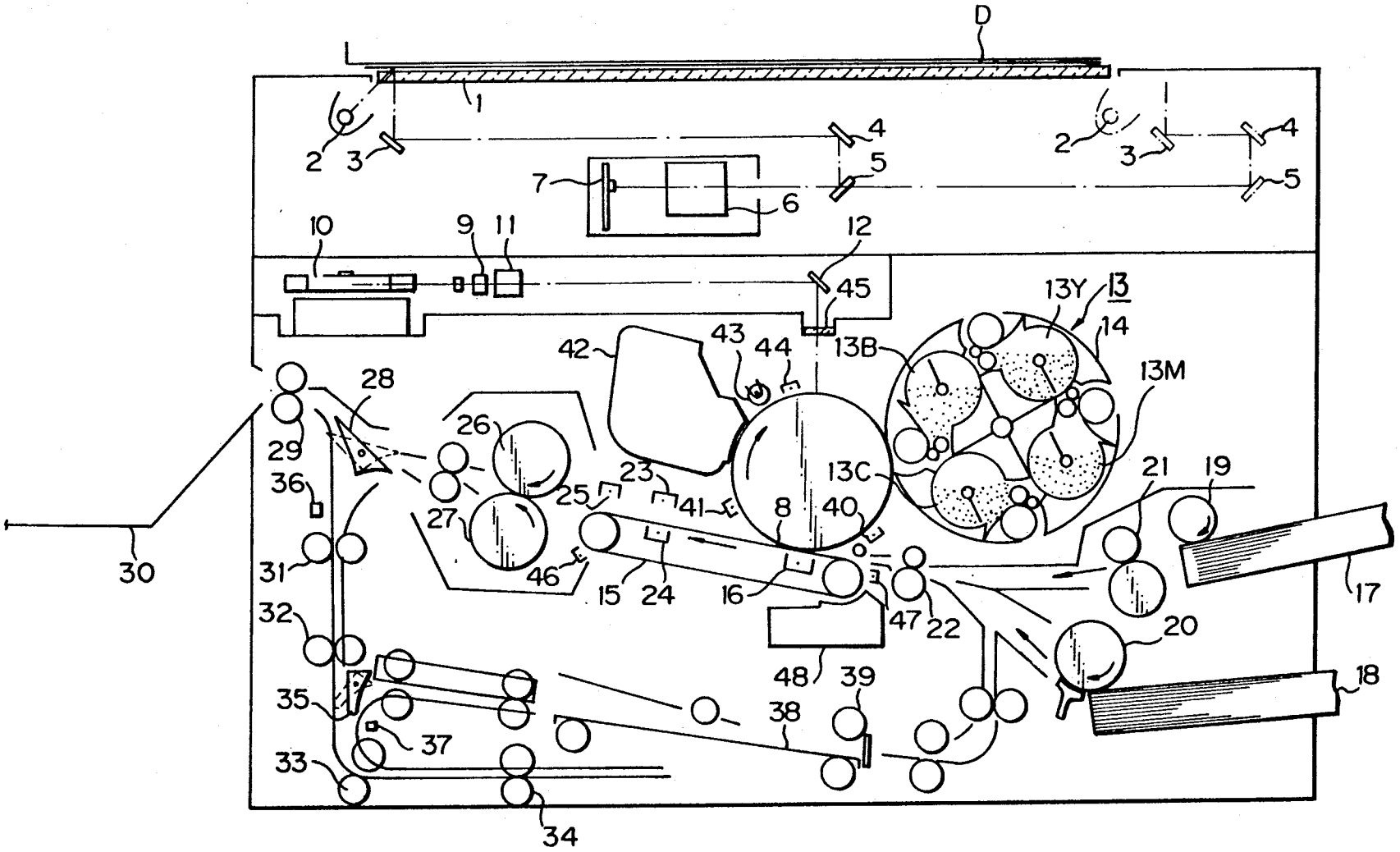
FIG. 1 is a section showing a specific construction of a color copier which is a specific form of an image forming apparatus embodying the present invention.

Referring to FIG. 1 of the drawings, an image forming apparatus embodying the present invention is shown and implemented as a color copier having an image reading device, an image writing device, a developing device, a fixing device, a paper feeding device, and a paper transporting device.

The image reading device has a glass platen 1 to be loaded with a document D, a lamp 2 for illuminating the document D, a first mirror 3 movable integrally with the lamp 2 in a scanning direction, a second and a third mirror 4 and 5 interlocked with the first mirror 3 to move in the same direction, a lens 6 for focusing an imagewise reflection from the document D, and a color imaging device 7 located at a focus position for photoelectrically converting an image by reading it pixel by pixel. When the document is illuminated, the color imaging device 7 separates an image printed on the document on a color basis and then transforms it into a digital signal.

The writing means writes an image on a photoconductive element 8 which is implemented as a drum. The writing means has a laser diode (LD) 9, a rotary polygonal mirror 10, optics 11 including an f-theta lens, and a mirror 12. The writing means converts the digital image data into currents on a color basis so as to drive the LD 9. The LD 9, therefore, outputs light which is substantially coincident with the density distribution of the document image. The light is steered by the polygonal mirror 10 onto the drum 8 via the optics 11 and mirror 12, whereby the document image is written on the drum 8. At this instant, a color image and a black-and-white image are written on the drum 8 as an ordinary or non-mirror image and a mirror image, respectively. If desired, the order in which images should be written on the drum 8 may be written to a buffer, not shown, and changed to form a non-mirror image and a mirror image on the drum 8; the buffer is not a frame memory.

A latent image written on the drum 8 by the writing device is converted into a toner image by the developing device which is generally designated by the reference numeral 13. The developing device 13 has a rotatable hollow cylinder 14 which is partitioned into four compartments. The four compartments each accommodates respective one of four developing units, i.e., a yellow (Y) developing unit 13Y, a magenta (M) developing unit 13M, a cyan (C) developing unit 13C, and a black (B) developing unit 13B. When a latent image to be developed by one of the developing units 13Y to 13B arrives at the developing unit of interest, the developing unit is brought to a position where it faces the drum 8 and thereby develops the latent image by a toner of particular color stored therein.

A color toner image which is not a mirror image as previously mentioned is transferred by a charger 16 to an intermediate transfer body 15 which is implemented as a belt and located to face the drum 8. Such an operation is repeated color by color to form a color image on the belt 15. A paper sheet is fed from a cassette 17 (or 18) by a pick-up roller 19 (or 20) and then driven by a feed roller 21 to a register roller 22. The register roller 22 is driven at a predetermined timing to feed the paper sheet such that the leading edge of the paper sheet meets the leading edge of a black toner image formed on the drum 8 or the leading edge of a color toner image transferred to the belt 15. The black toner image is transferred to the paper sheet by the charger 16, while the color toner image on the belt 15 is transferred to the paper sheet by chargers 23 and 24. The paper sheet carrying the image thereon is separated from the belt 15 by a charger 25 and then transported to the fixing unit.

The fixing unit has a pair of fixing rollers 26 and 27 which face each other. While the paper sheet separated from the belt 15 moves between the fixing rollers 26 and 27, the toner image on the paper sheet is fixed. The paper sheet with the fixing image is steered by a first selector in the form of a pawl 28. Specifically, when the selector 28 is positioned as indicated by a solid line in the figure, it steers the paper sheet to a copy tray 30 by way of a roller 29. When the selector 28 assumes a position indication by a phantom line, it once steers the paper sheet downward. At this instant, a second selector or pawl 35 is positioned as indicated by a solid line. After the trailing edge of the paper sheet has moved away a paper sensor 36, rollers 31 to 34 are once brought to a stop. On the return of the first selector 28 to the solid-line position, the rollers 31 to 34 are reversed. As a result, the paper sheet is driven out onto the copy tray 30 face down by the roller 29. On the other hand, when the first selector 28 is in the phantom-line position, the second selector 35 is moved to the phantom-line position after the trailing edge of the paper sheet has moved away from the paper sensor 37. In this condition, the rollers 31 to 34 are once stopped and then reversed to stack the paper sheet on an intermediate tray 38 which plays the role of an intermediate stacking device. In response to the subsequent copy command, a refeed roller 39 drives the paper sheet out of the intermediate tray 38 toward the register roller 22. The paper transporting device is constructed and arranged as stated above.

Various units and drives are arranged around the drum 8 and belt 15, as follows. A charger 40 lowers the potential of the drum 8 under the toner image so as to promote efficient image transfer. A charger 41 lowers the potential of the drum 8 under the toner which remains on the drum 8 after the image transfer, so that a cleaning device 42 may remove all of the remaining toner from the drum 8. A discharge lamp 43 dissipates the charge remaining on the drum 8, and a charger 44 charges the drum 8. Dust-proof glass 45 prevents the writing device from being contaminated by the toner and impurities such as paper dust. A charger 46 inverts the polarity of the surface of the belt 15. A charger 47 inverts the polarity of the belt 15 having been cleaned. A cleaning device 48 removes the toner which remains on the belt 15 after the image transfer. While the belt 15 carries a toner image thereon, the cleaning device 48 is held in an inoperative position.

Figure 2:
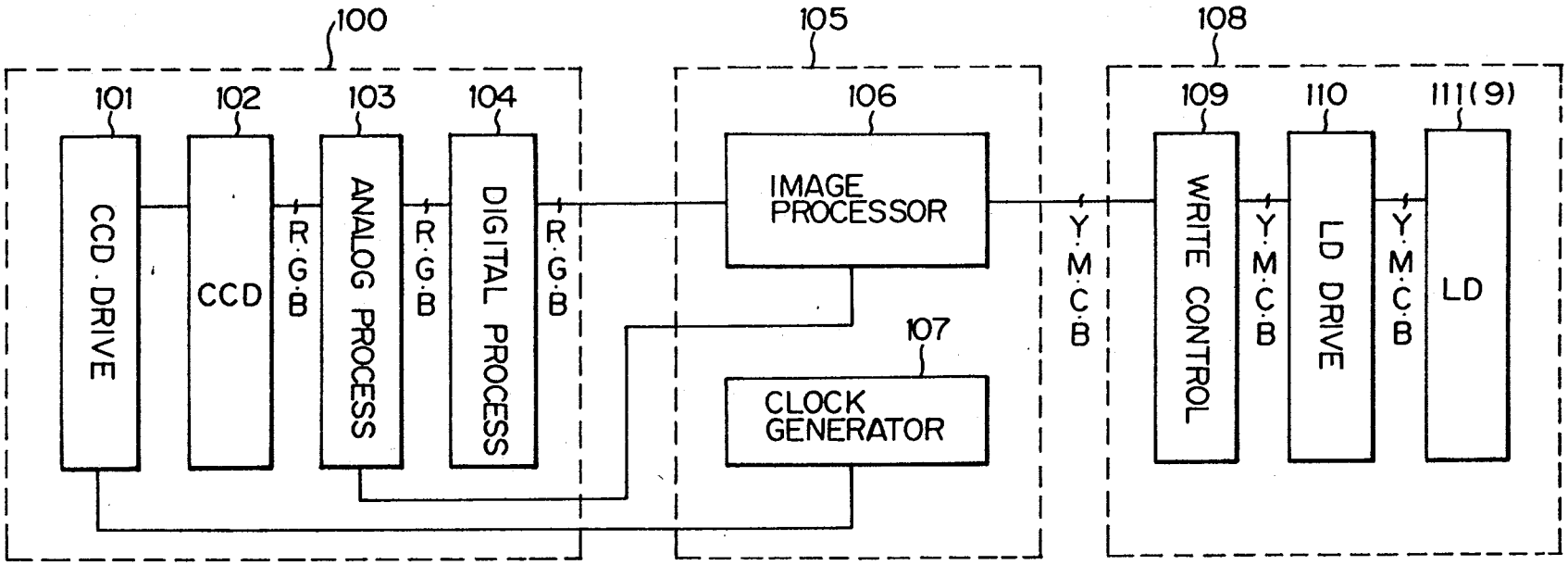
FIG. 2 is a block diagram schematically showing an image data processing system particular to the color copier.

A first embodiment of the image data processing system practicable with the above-described color copier will be described with reference to FIG. 2. As shown, the system has an image reading section 100, an image processing section 105, an image writing section 108, an a storing section, not shown. The image reading section 100 has a CCD (Charge Coupled Device) array, or imaging device, 102 for effecting photoelectric conversion of document image data. A CCD driver 101 drives the CCD array 102 on the basis of a resolution (dots/millimeter). Electric signals representative of color components R (red), G (green) and B (blue) and outputted by the CCD 102 each is amplified, corrected as to dark current and shading, and converted into digital image data by an analog processing section 103. A digital processing section 104 corrects the deviation of reading lines of the individual color components constituting the digital image data. As a result, the individual color component signals are fed to the image processing section 105 without positional deviation. The image processing section 105 has a clock generator 107 which generates a reference image frequency and feeds it to the CCD driver 101. An image processing unit 106 executes color processing (e.g. changing R, G and B to Y, M and C), magnification processing, etc. This unit 106 determines whether the document D is a black-and-white document or a color document and transfers the Y, M, C and M image data to the writing section 108. The writing section 108 has a write control 109 for correcting the writing speed, deviation in writing position, etc. An LD driver 110 transforms a digital signal representative of image density into an LD drive current by pulse width modulation (PWM) or power modulation. The LD drive current is applied to an LD 111, i.e., LD 9 shown in FIG. 1.

Figure 3:
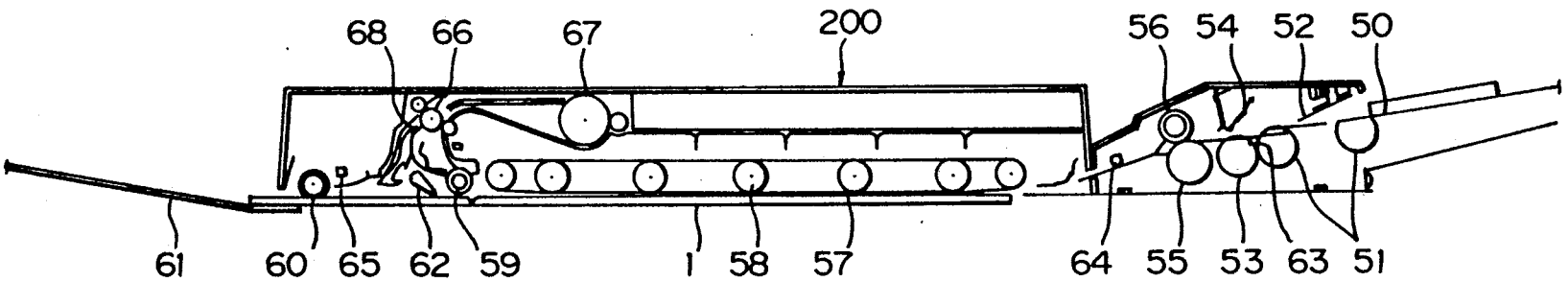
FIG. 3 is a section showing a specific construction of an automatic document feeder applicable to the color copier.

FIG. 3 shows a specific construction of an automatic two-sided document feeder applicable to the color copier. As shown, the automatic document feeder or automatic recylcing document feeder (ARDF) 200 has a table 50 on which documents D are stacked. A pick-up roller 51 feeds the documents from the table 50 one by one, the first or lowermost page being first. An inlet guide Mylar 52 urges the document D against the pick-up roller 51. The document D having the first page (lowermost page) is separated from the others by a separating roller 53 and a separating blade 54 and driven toward pull-out rollers 55 and 56. At this instant, the pick-up roller 51 and separating roller 53 are brought to a stop so that the document D is transported only by the pull-out rollers 55 and 56. A transport belt 57 is driven by a press roller 58 to transport the document D to a predetermined position on the glass platen 1. After the document D has been illuminated on the glass platen 1, the transport belt 57 again transports the document. An intermediate transport roller 59 and a discharge roller 60 cooperate to drive the document D onto a tray 61. At this time, a selector in the form of a pawl 62 is held in a horizontal or raised position so as not to lie in the document transport path. Document sensors 63, 64 and 65 function to determine whether or not the document D is present.

The ARDF 200 is capable of turning over the document D, as follows. The document D having been illuminated on the glass platen 1 is transported by the transport belt 57, as mentioned above. At this instant, the selector 62 is held in a lowered position, as shown in FIG. 3. Hence, the document D is transported vertically upward and then caused to make a turn by rollers 66 and 67 toward the glass platen 1. At this time, the transport belt 57 is reversed to transport the document D to the predetermined position on the glass platen 1. In this condition, the other side of the document D is illuminated. Thereafter, as the belt 57 coneys the document D, the selector 62 held in the lowered position. FIG. 3, steers the document D again vertically upward. After the trailing edge of the document D has moved away from a reversal inlet sensor 68, a motor, not shown, for driving the roller 66 and 67 is reversed to discharge the document D onto the tray 61. At this time, the next document has been fed from the table 50 to the predetermined position on the glass platen 1. By such a procedure, the documents D are sequentially driven out onto the tray 61 in order of page.

A reference will be made to FIG. 4 for describing the control system of the entire color copier. As shown, the fixing rollers 26 and 27, FIG. 1, each has a heating element 120 therein. A system controller 121 has a main control section and a key input control section associated with an operation board, not shown. Various kinds of copy modes entered on the operation board are processed by the key input control section and then fed to the image processing section 105 as data. The image processing section 105 executes processing such as magnification change processing on the basis of the input data. The data representative of the copy modes is also applied to a motor control section 122, a process control section 123, etc. The motor control section 122 controls motors adapted to drive a scanner, transport, development and transfer belts and so on in a predetermined manner. The process control section 123 controls the turn-on and turn-off of the lamp, high-tension power sources as well as their output values. Sensors 124 are responsive to the presence/absence of a paper sheet and the surface temperature of the fixing rollers 26 and 27 and apply their outputs to the system controller 121. DC loads include electromagnetic clutches associated with the feed rollers, electromagnetic solenoids associated with the selectors, etc. The main control section of the system controller 121 controls the operations of the DC loads 125. Optional units 126 include the automatic document feeder. A DC power source 127 applies power to the various loads.

Figure 5:
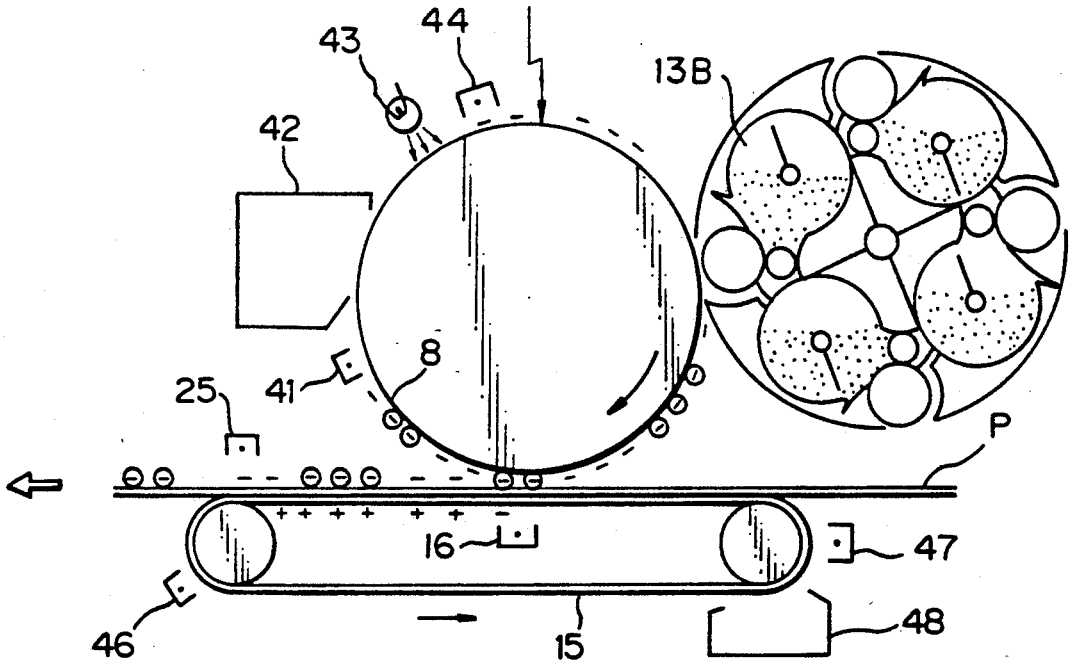
FIGS. 5 to 10 are views each showing a specific copying operation.
Figure 6:
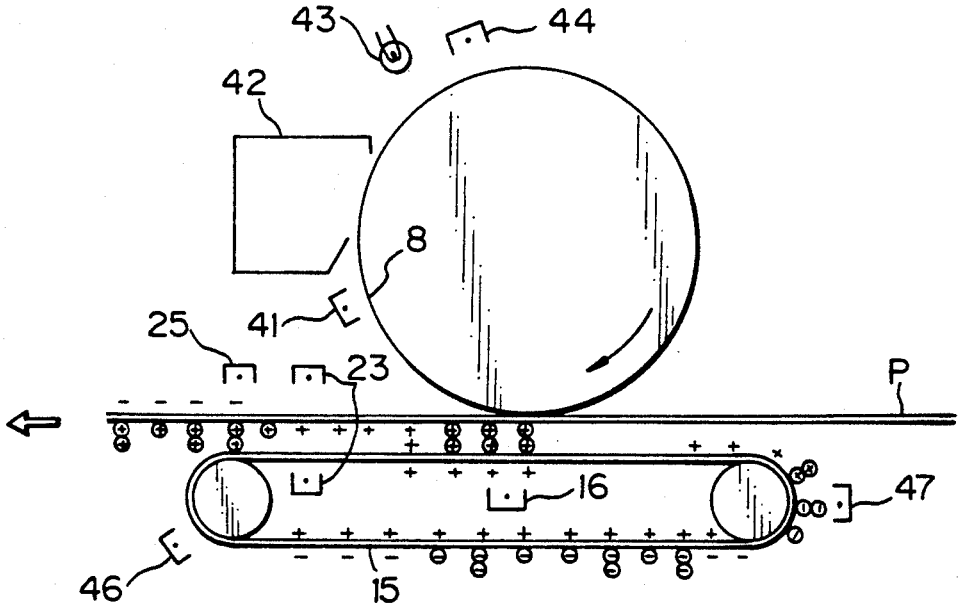
Figure 7:
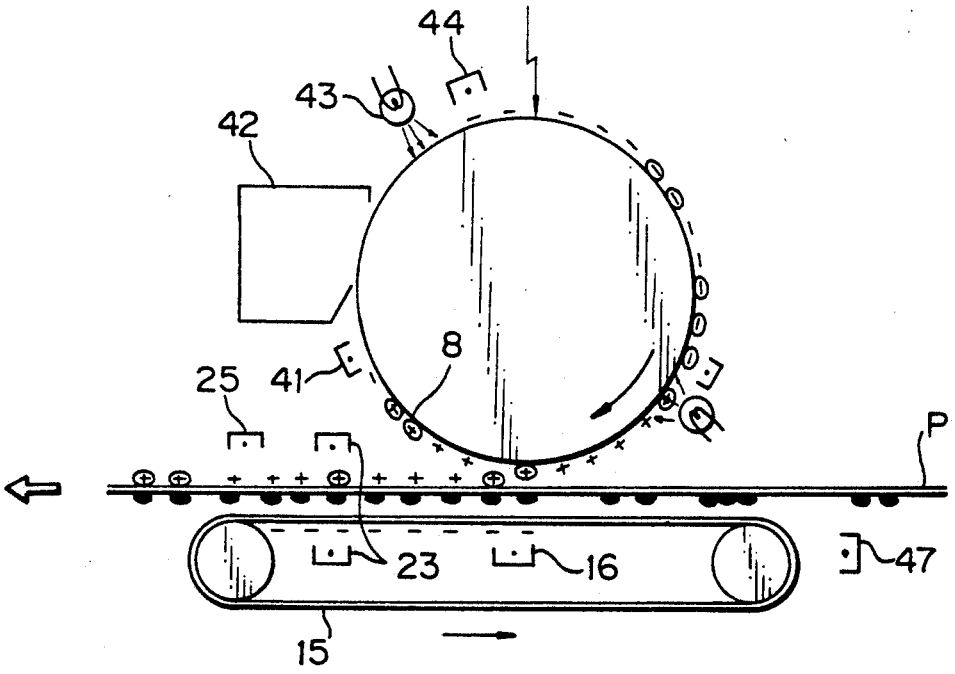
Figure 8:
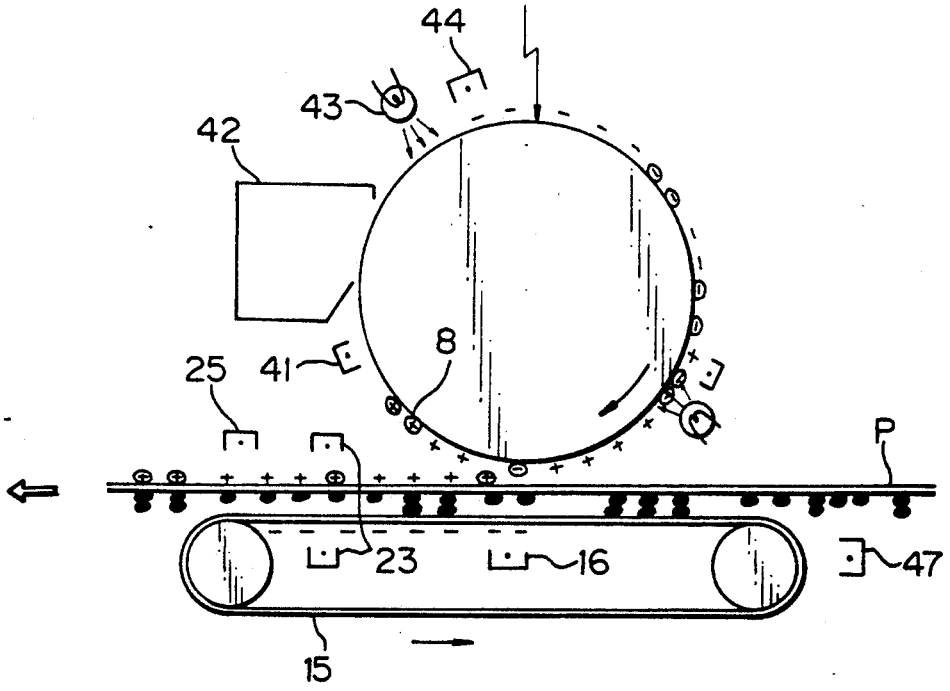
Figure 9:
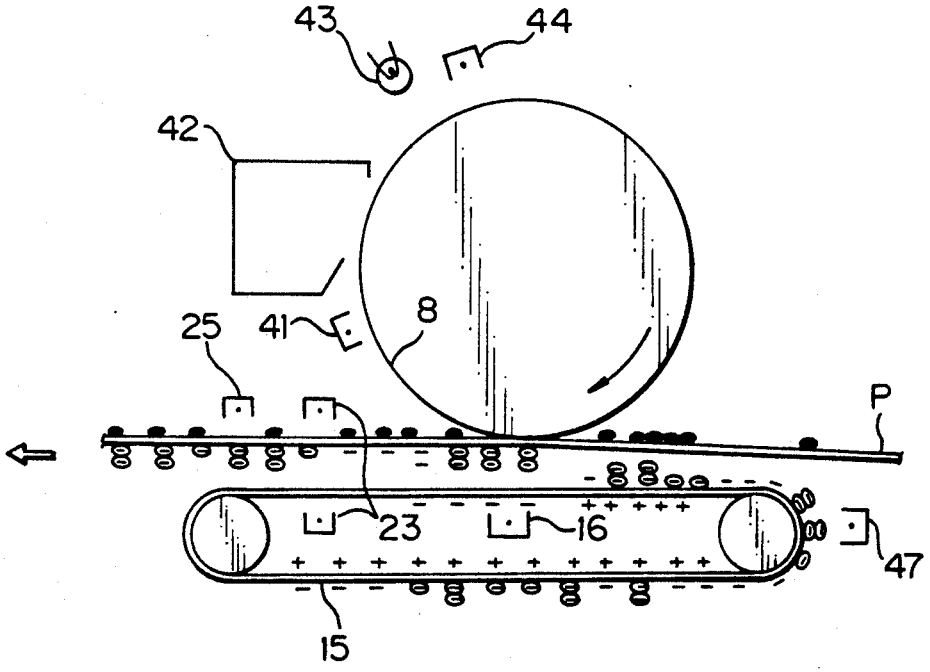
Figure 10:
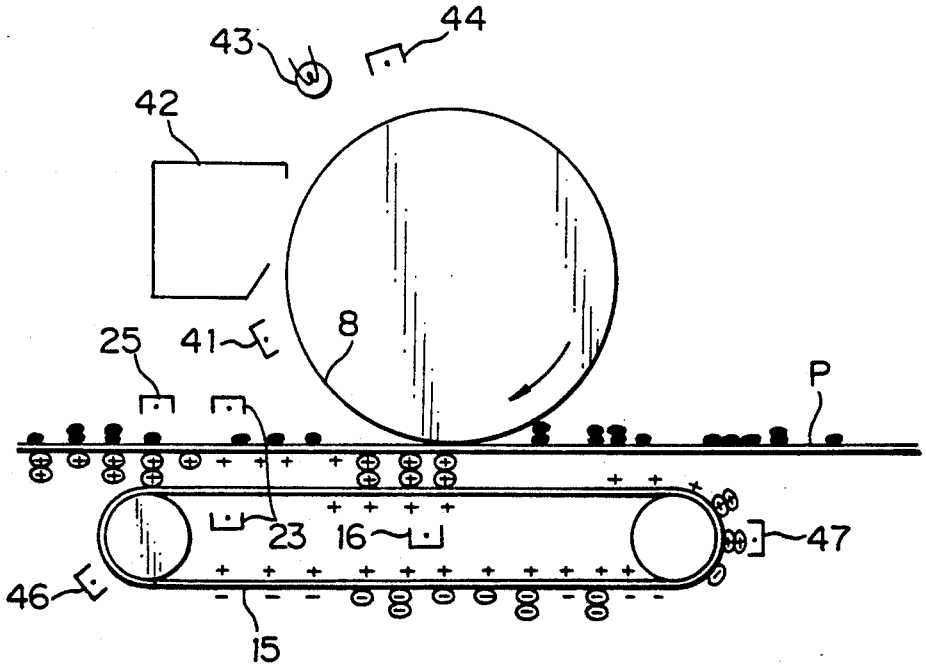

Image forming modes will be described with reference to FIGS. 5 and 6. Specifically, FIG. 5 shows an image forming mode associated with an ordinary black-and-white document. A latent image in the form of a mirror image formed on the drum 8 is developed by the B developing unit 13B and then transferred to the front of a paper sheet P. FIG. 6 shows an image forming mode associated with an ordinary color document. As shown, latent images each being representative of a particular color component and not a mirror image are developed by the associated developing sections 13, sequentially transferred to the belt 15 one upon another, and then transferred to the rear of a paper sheet P.

An automatic two-sided copying operation for producing a two-sided copy which is a replica of a two-sided document is as follows. First, while the first document D is moved on and along the glass platen 1 by the ARDF, the image reading device reads the document. The document moved away from the glass platen 1 is turned over as shown in FIG. 3, and again set on the glass platen 1. In this condition, the image reading device reads the other or second side of the document D. Therefore, the copying operation is effected in different manners as tabulated below.

TABLE 1

| DOCUMENT | | TRANSPORT MODE | TRANSPORT MODE |
|---|---|---|---|
| 1ST SIDE | 2ND SIDE | TO STACK MEANS | DURING DISCHARGE |
| BLACK & WHITE | BLACK & WHITE | reverse | reverse |
| BLACK & WHITE | COLOR | non-reverse | non-reverse |
| COLOR | BLACK & WHITE | non-reverse | non-reverse |
| COLOR | COLOR | reverse | reverse |

The copying operation begins with the second side (current exposing side of the document D. Regarding the reading direction, a black-and-white document is read in the opposite direction to the ordinary direction while a color document is read in the ordinary direction, with no regard to the side of the document D. The document image read is processed by the system shown in FIG. 2 to form a latent image on the drum 8. The developing device 13 develops the latent image to produce a toner image. Then, the toner image is transferred to and fixed on the paper sheet P, as shown in FIGS. 5 or 6. To stack the paper sheet P on the intermediate tray 38, a particular paper transport mode is selected, as shown in Table 1. In Table 1, the term "reversal" means that the paper sheet P is turned over by the system shown in FIG. 1 before it is stacked on the tray 38, while the term "non-reversal" means that it is stacked on the tray 38 without being turned over. After the second side of the document D has been reproduced, the document D is turned over by the system of FIG. 3 and then transported to the glass platen 1 with the first side thereof facing downward.

Referring to FIGS. 7 to 10, the transfer of an image representative of the first side of the document D to the paper sheet P will be described. Specifically, FIGS. 7 to 10 relate respectively to a document carrying a black-and-white image on both sides thereof, a document carrying a black-and-white image on the first side and a color image on the second side, a document carrying a color image on the first side and a black-and-white image on the second side, and a document carrying a color image on both sides thereof.

The paper sheet P with a fixed image is discharged in a particular transport mode, as shown in Table 1. Again, the term "reversal" refers to a transport mode which turns over the paper sheet P shown in FIG. 1 while the term "non-reversal" refers to a transport mode which discharges it without reversal.

In the manner described above, two-sided documents each carrying a black-and-white image and/or a color image and paper sheets which are the reproductions thereof are driven out of the copier in order of page.

It is to be noted that each document which has fully undergone the reading operation is discharged to the tray 61 without being routed through the reversing section.

Figure 11:
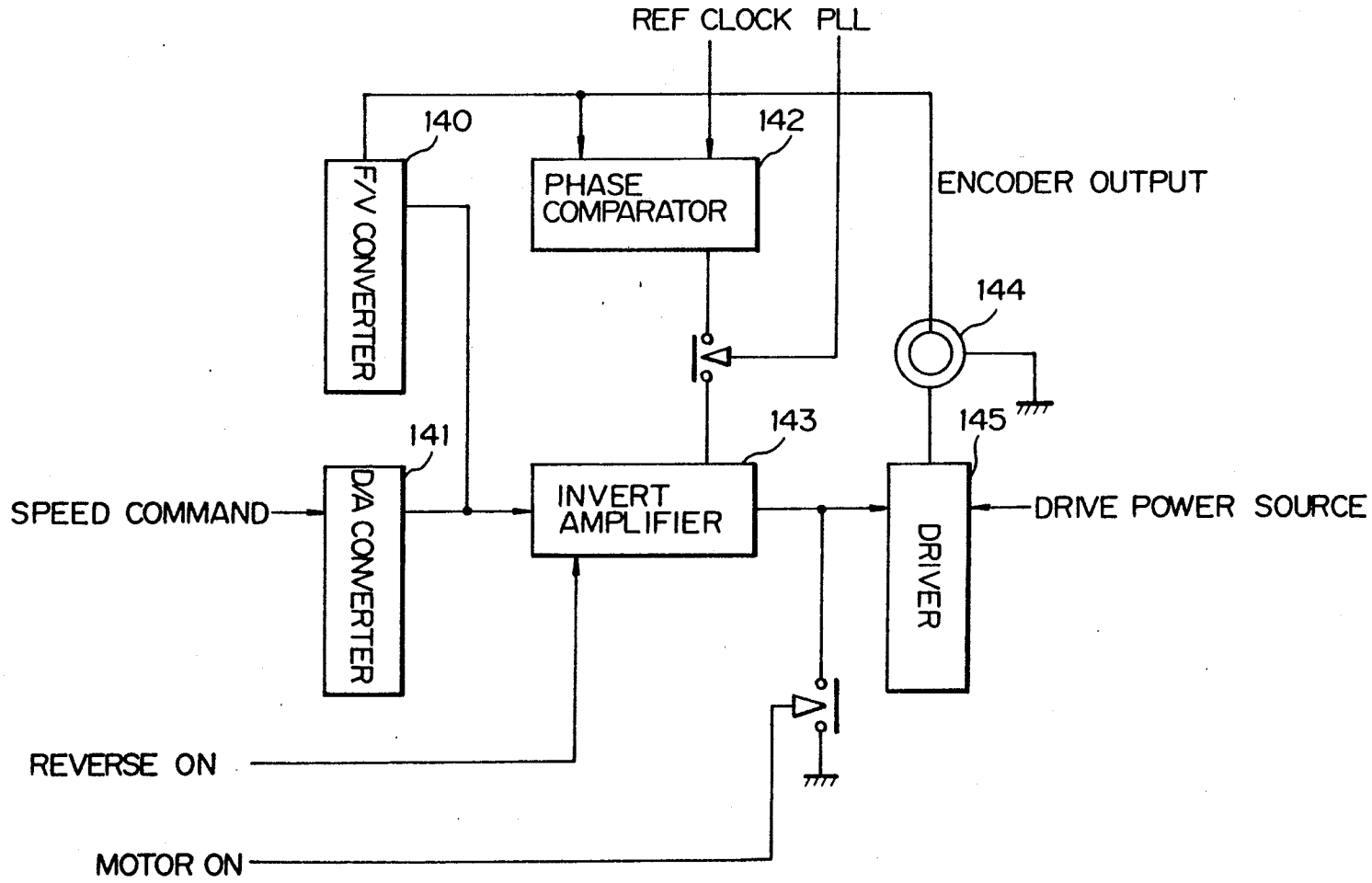
FIG. 11 is a block diagram schematically showing a scanner drive control section.

FIG. 11 shows a scanner drive control section. As shown, this section has a frequency-to-voltage (F/V) converter 140, a digital-to-analog (D/A) converter 141, a phase comparator 142, an inverting amplifier 143, a scanner motor 144, and a driver 145. All the inputs to the scanner drive control section are fed from the main control section included in the system controller 121.

Figure 12:
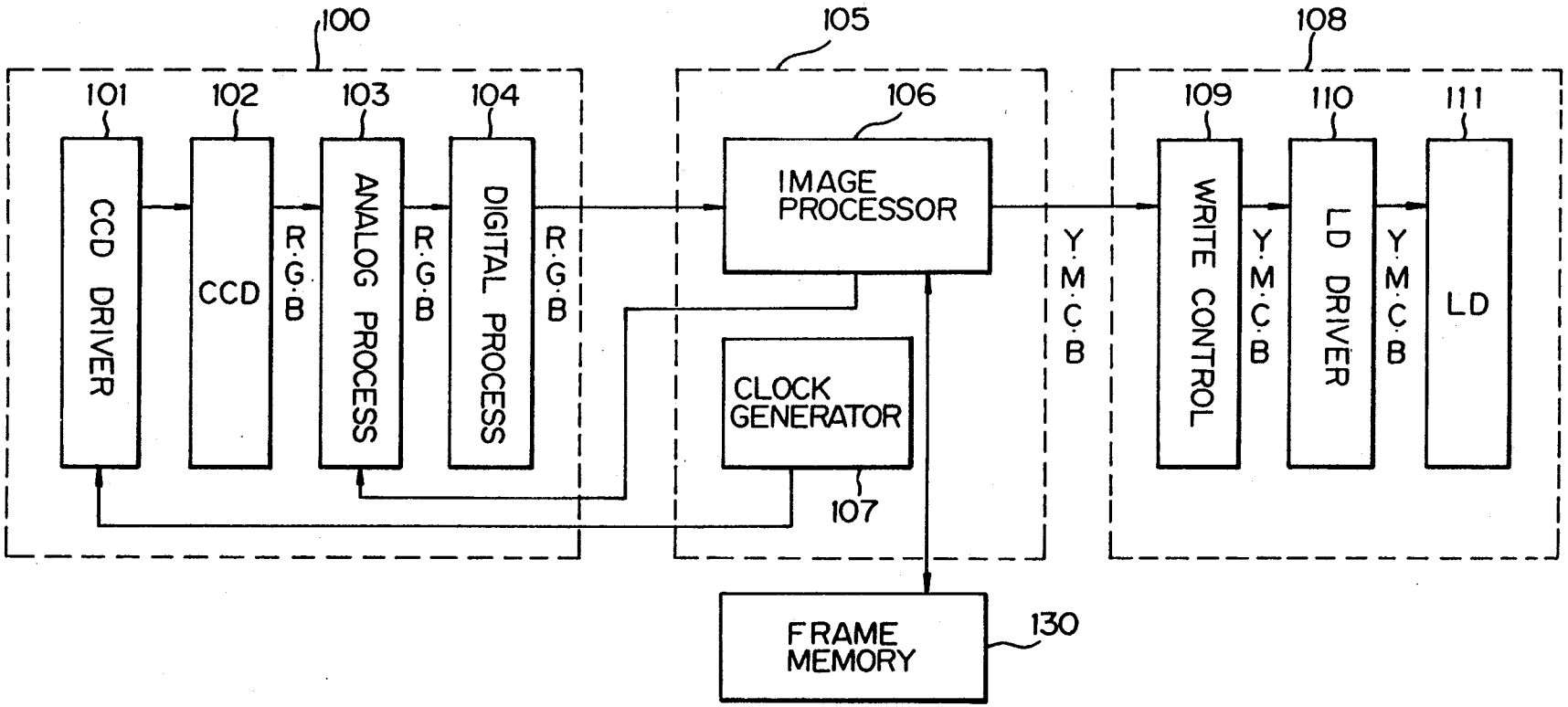
FIG. 12 is a block diagram showing an alternative embodiment of the image data processing section.
Figure 13:
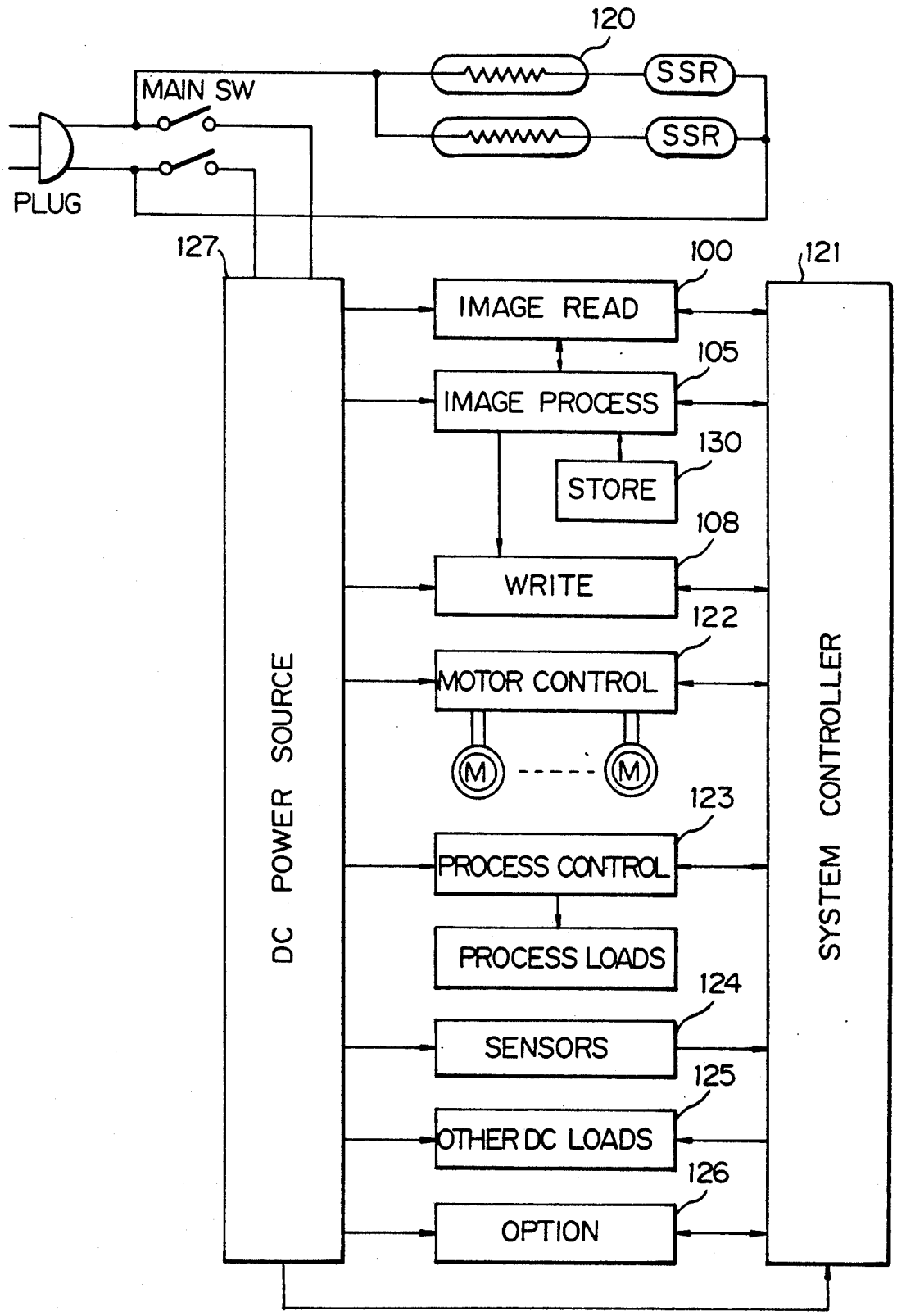
FIG. 13 is a block diagram showing an alternative embodiment of the control system for controlling the entire color copier.

Referring to FIG. 12, an alternative embodiment of the image data processing system is shown. This embodiment is essentially similar to the embodiment of FIG. 2 except for part thereof which will be described. A storing section 130 is implemented as a frame memory and capable of storing the respective color components having undergone color processing and representative of one document as data Y, M, C and B. FIG. 13 shows a control system corresponding to the control system of FIG. 4. The storing section 130 interchanges data with the image data processing system 105.

An automatic two-sided copy mode for reproducing a two-sided copy representative of a two-sided document and particular to this embodiment will be described with reference to FIGS. 14 to 17. First, the automatic document feeder shown in FIG. 3 feeds the first document D to the glass platen 1. Then, the image reading device reads the first side of the document D in the ordinary direction. The resulted image data is processed by the image processing section 105, FIG. 12, and then stored in the storing section or frame memory 130. Thereafter, the document D is caused to make a turn by the document reversing means, FIG. 3, and again transported to the glass platen 1. In this condition, the image reading device reads the second side of the document D. Hence, the copying operation is effected in a particular manner, as shown in Table 2 below.

TABLE 2

| DOCUMENT | | 2ND SIDE PROCESSING | | 1ST SIDE PROCESSING | | IMAGE | | TRANSPORT | TRANSPORT |
|---|---|---|---|---|---|---|---|---|---|
| 1ST SIDE | 2ND SIDE | READ DIRECTION | WRITE | IMAGE DATA OUTPUT | WRITE | FORMING ORDER-SIDE | TRANSFER MODE | MODE TO STACK MEANS | MODE DURING DISCHARGE |
| BLACK & WHITE | BLACK & WHITE | reverse | mirror | first | non-mirror | 1st side | simultaneous | — | non-reverse |
| BLACK & WHITE | COLOR | forward | non-mirror | last | mirror | 2nd side | simultaneous | — | reverse |
| COLOR | BLACK & WHITE | reverse | mirror | first | non-mirror | 1st side | simultaneous | — | non-reverse |
| COLOR | COLOR | forward | non-mirror | last | non-mirror | 2nd side | TWICE | reverse | non-reverse |

In Table 2, the column "2ND SIDE PROCESSING", the terms "forward" and "reverse" refer to the ordinary reading direction and the opposite reading direction, respectively. In the same column, the term "WRITE" refers to a mode for writing the image on the drum 8, i.e., a non-mirror mode which writes one line of image on the drum 8 in the same order as the reading order or a mirror mode which writes it on the drum 8 in the opposite order. The non-mirror image is developed and then transferred as a mirror image to the belt 15 by the charger, or first charging means, 16. As shown in the column "IMAGE DATA OUTPUT", image data is read out of the frame memory 130 in the same order as the writing order as represented by the term "first" or in the opposite order as represented by the term "last". Regarding the terms "non-mirror" and "mirror", this column is the same as the above-mentioned column. The term "IMAGE FORMING ORDER" refers to a latent image to be formed on the drum 8 first.

Figure 14:
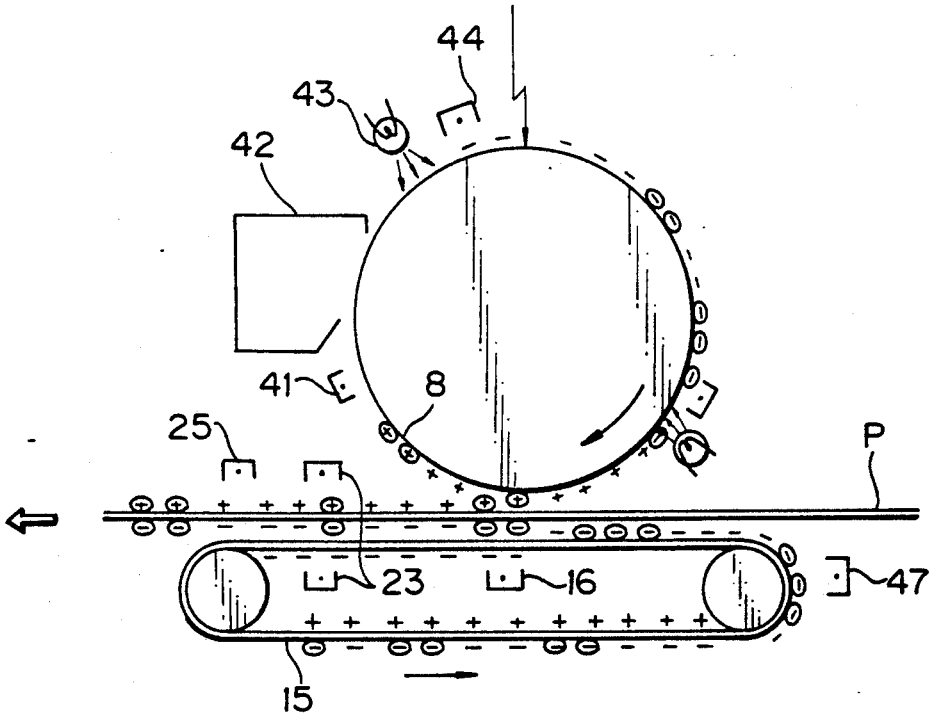
FIGS. 14 to 20 are views each showing a specific copying process.
Figure 15:
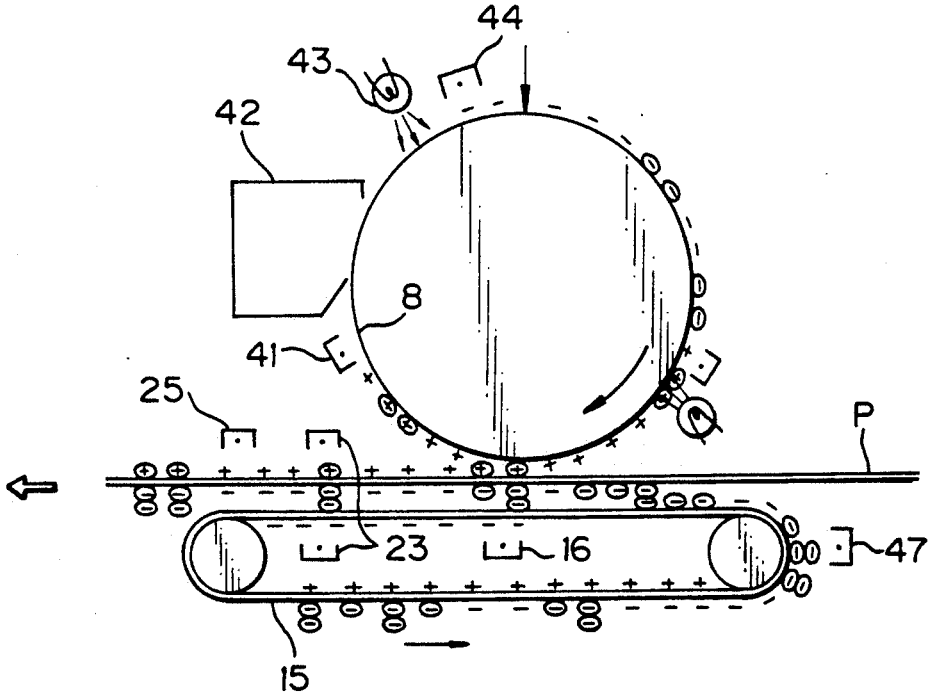
Figure 16:
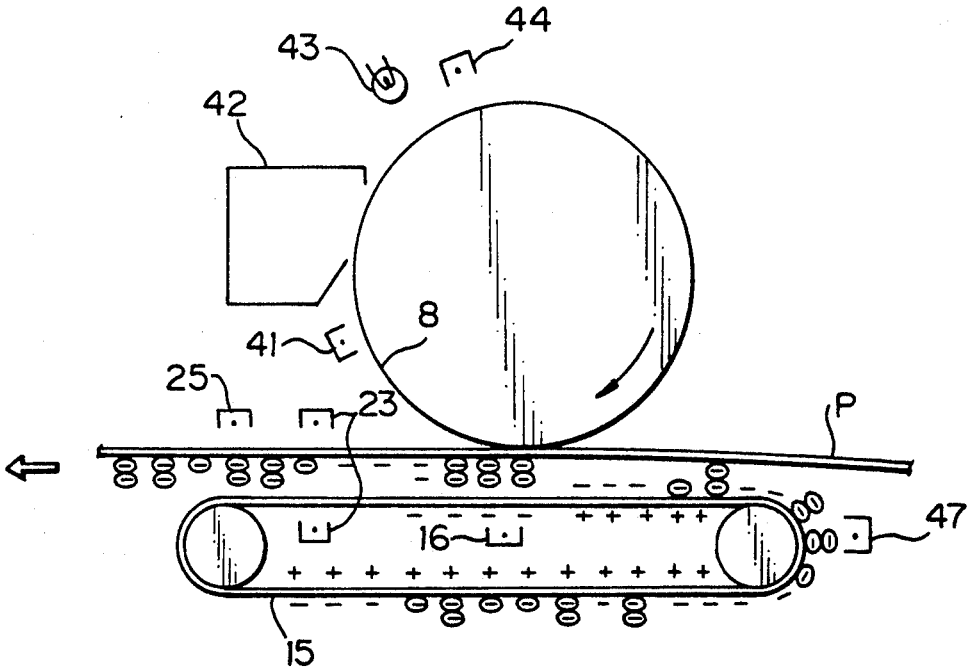
Figure 17:
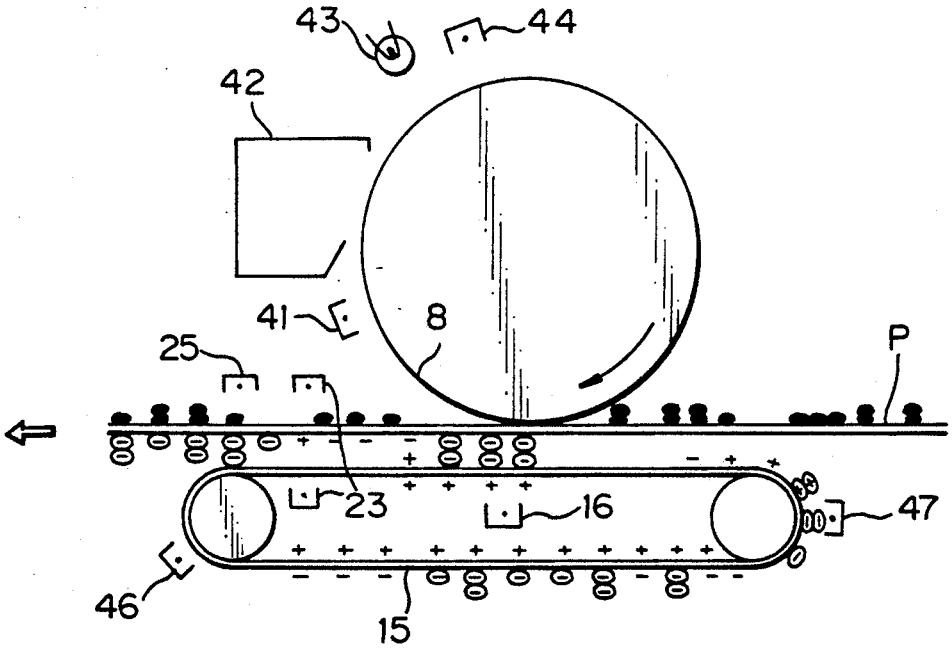

FIG. 14 demonstrates a condition wherein a document carrying a black-and-white image on both sides thereof is reproduced on the paper sheet P at the same time. As shown, the toner images on the drum 8 and belt 15 are transferred to the paper sheet P by the chargers, or first and second transferring means, 16 and 23, respectively. FIG. 15 and FIGS. 16 and 17 show respectively the simultaneous transfer associated with a two-sided black-and-white and color document and the transfer of a two-sided color document. Regarding a two-sided color document, the second side is transferred to and fixed on the paper sheet P, then the paper sheet P is turned over, and then the paper sheet P is stacked on the intermediate tray, or stacking means, 38. Such a procedure is repeated until a desired number of copies have been produced. Thereafter, the first side of the document is reproduced as a toner image on the belt 15, and then the paper sheet P is refed from the intermediate tray 38 to transfer it.

Further, in the column "TRANSPORT MODE DURING DISCHARGE", the terms "non-reverse" and "reverse" refer respectively to discharging the paper sheet P with a fixed image directly to the tray 30 and discharging it after turning it over. The document D having undergone the reproduction is again turned once by the arrangement of FIG. 3 and then driven out onto the tray 61.

Figure 18:
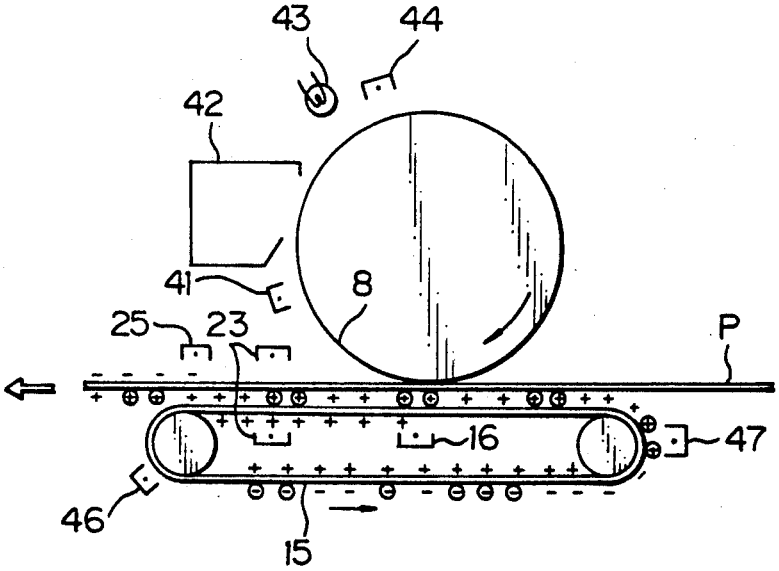

When a page-sequential paper discharge mode is selected with a stack of black-and-white and color documents, black-and-white documents are reproduced in a particular manner which is shown in FIG. 18. Color documents are reproduced by the procedure described with reference to FIG. 6. Specifically, after a non-mirror latent image representative of a black-and-white document has been formed on the drum 8, it is developed by the B developing unit 13B. The resulted black toner image is transferred to the belt 15 and then to the rear of the paper sheet P.

In the page-sequential paper discharge mode effected with the mixture of black-and-white and color documents, the black-and-white documents and the color documents are reproduced by the procedures shown in FIGS. 5 and 6, respectively. The difference is that a paper sheet representative of a black-and-white document is discharged after reversal as shown in FIG. 1 while a color document is read in the opposite direction to the ordinary reading direction.

Figure 19:
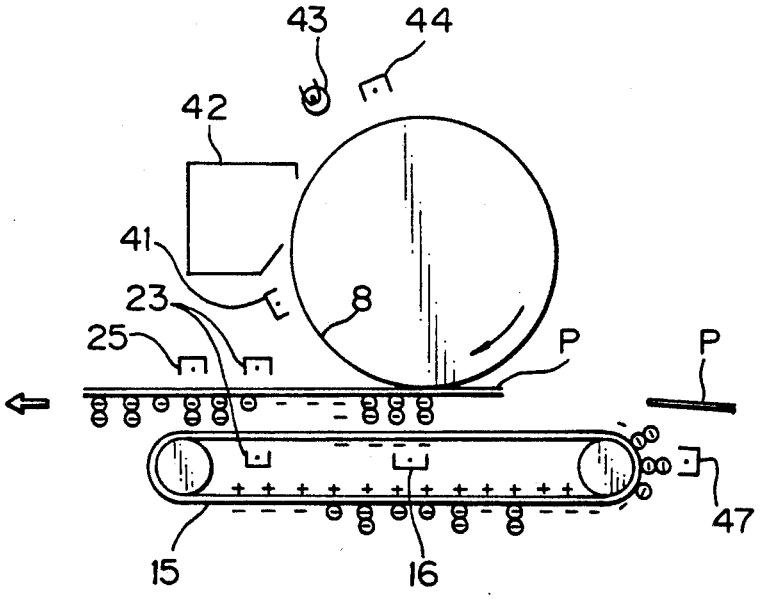
Figure 20:
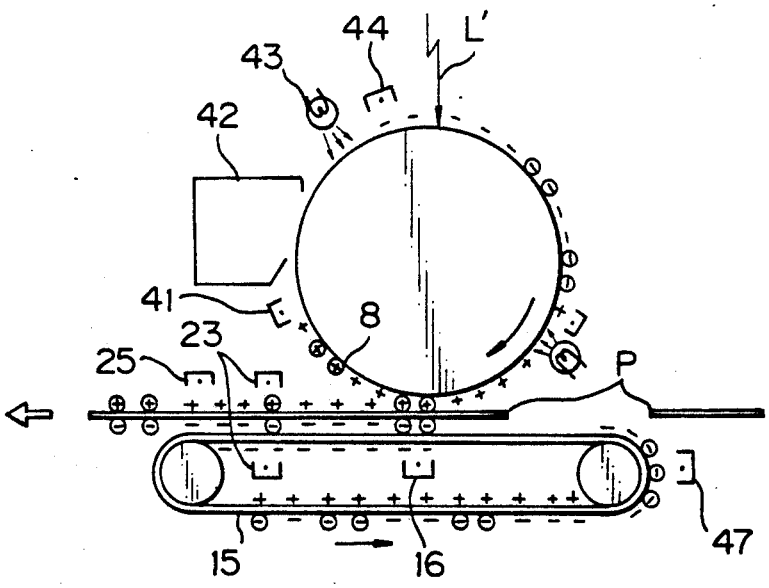

FIGS. 19 and 20 show respectively a composite copy mode operation and a two-sided copy mode operation specifically. In the modes shown in FIGS. 19 and 20, images corresponding to two paper sheets are formed on the belt 15. In the composite or two-side copy mode, a constant N is produced by an equation:

$$L \geqq N \cdot l_1 + (N-1) \cdot l_2 + l_0$$

where $l_1$ is the size of the paper sheet P as measured in the feed direction, $l_2$ is the predetermined distance between paper sheets, $l_0$ is the distance between the write position and the first transfer position, and L is the circumferential length of the belt 15.

Figure 4:
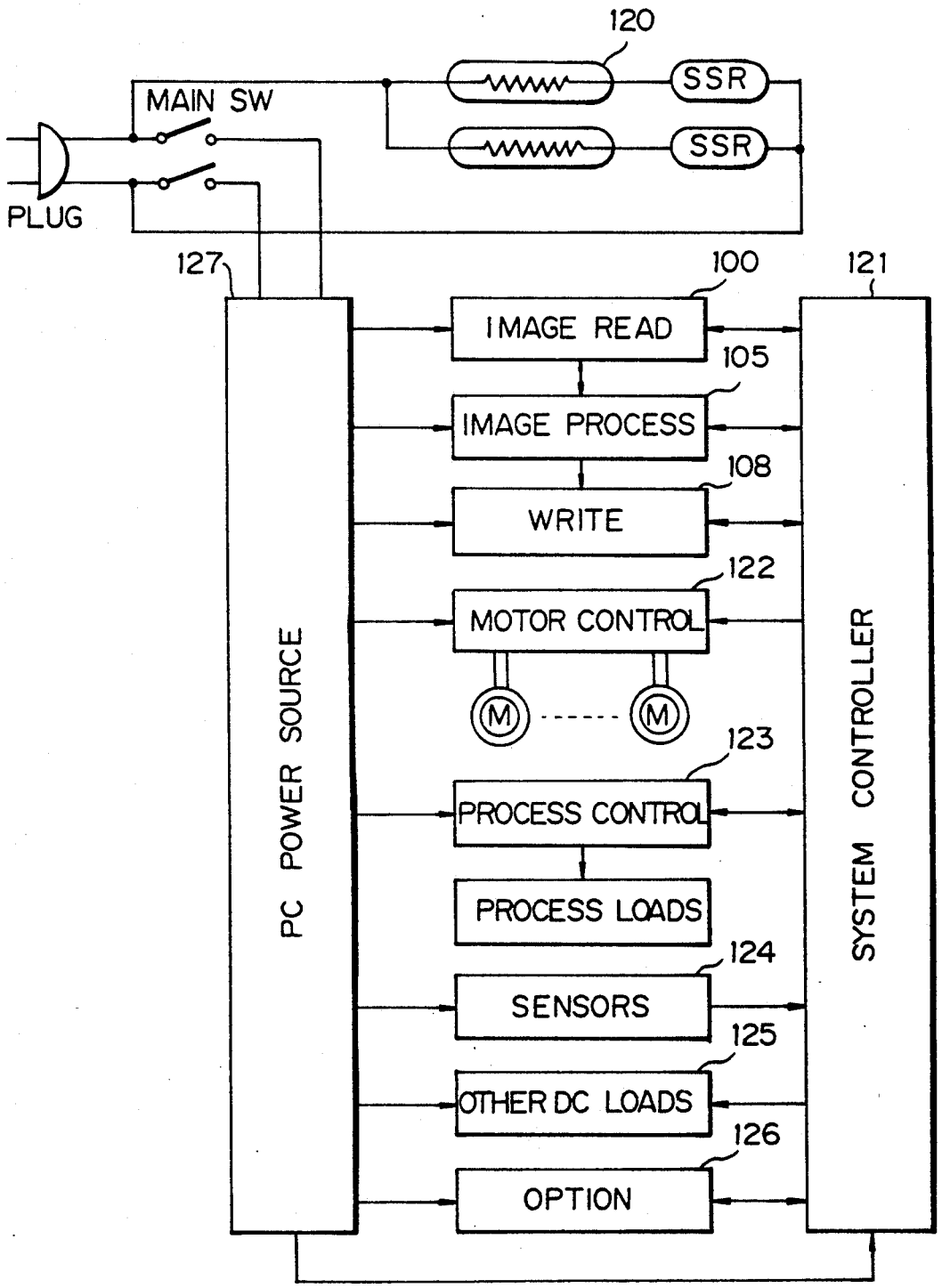
FIG. 4 is a block diagram schematically showing a first embodiment of the control system for controlling the entire color copier.

The constant N is produced with each paper sheet P and written to the main control section of the system controller 121, FIG. 4.

Then, the set number of copies n is compared with the constant N. If n is equal to or smaller than N, the composite copy mode shown in FIG. 19 or the two-sided copy mode shown in FIG. 20 is executed. First, non-mirror latent images corresponding to n images of the first document are formed on the drum 8, and then developed by the developing device 13. The resulted toner images are transferred to the belt 15 by the charger 16. Regarding the second document, in the composite copy mode, an image is formed in the same manner as with the first document, transferred to the belt 15 over the image of the first document, and then transferred to the rear of a paper sheet by the charger 23.

In the two-sided copy mode, the second document is read in the opposite direction to the first document to form a latent mirror image on the drum 8. After the latent image has been developed by the developing device 13, the resulted toner image on the drum 8 is transferred to the front of the paper sheet P by the charger 16 while the toner image on the belt 15 is transferred to the rear of the paper sheet P by the charger 23.

In summary, the present invention provides an image forming apparatus which automatically selects a page-sequential paper discharge mode when an automatic two-sided copy mode is selected, thereby arranging paper sheets, or copies, in order of page when a stack of black-and-white and color documents are used.

The apparatus of the invention has a storage capable of storing one document of image data. Hence, when two-sided documents other than two-sided color documents are reproduced, images can be transferred to both sides of a paper sheet at the same time without resorting to the replacement of documents. This is successful in preventing a paper sheet from jamming the path when driven toward stacking means or from being incompletely stacked.

When automatic document feeding means is used to reproduce documents (especially a mixed stack of black-and-white documents and color documents), a page-sequential paper discharge mode can be selected automatically.

Despite reversing means, the page-sequential paper discharge mode can be selected automatically.

Further, in a composite or two-sided copy mode, a plurality of toner images each being representative of the first document are formed on a transfer belt on the basis of a relation between paper sheets to be used and the desired number of copies. Hence, a composite or two-sided copy is achievable by single replacement of documents and single paper feed operation (per paper sheet) without resorting to intermediate stacking means.

In addition, when black-and-white documents and color documents are stacked together, a control means allows copies to be produced in order of page.

Various modifications will become possible for those skilled in the art after receiving the teachings of the present disclosure without departing from the scope thereof.

What is claimed is:

1 An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

reversing means for reversing a direction in which a recording medium is discharged in order to execute a page-sequential medium discharge mode;

stacking means for refeedably stacking, in a composite copy mode or a two-sided mode, recording media each carrying an image on a first side thereof;

automatic document feeding means for transporting a recording medium to a predetermined position for illumination on a glass platen and having a reversing function for automatically turning over said recording medium;

a first control means for selecting said page-sequential medium discharge mode when an automatic two-sided copy mode using said automatic document feeding means is selected; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

2. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

automatic document feeding means for automatically feeding a document to a predetermined position for illumination defined on a glass platen;

a first control means for automatically selecting a page-sequential medium discharge mode when copying using said automatic document feeding means is selected; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

3. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

automatic document feeding means for transporting a document to a predetermined position for illumination defined on a glass platen;

a first control means for automatically selecting a page-sequential medium discharge mode when copying using said automatic document feeding means is selected; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

4. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

reversing means for reversing a direction in which a recording medium is discharged in order to execute a page-sequential medium discharge mode;

an automatic document feeding means for automatically transporting a document to a predetermined position for illumination defined on a glass platen;

a first control means for automatically selecting a page-sequential medium discharge mode when copying using said automatic document feeding means is selected; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

5. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

reversing means for reversing a direction in which a recording medium is discharged in order to execute a page-sequential medium discharge mode;

stacking means for refeedably stacking, in a composite copy mode or a two-sided mode, recording media each carrying an image on a first side thereof;

a first control means for allowing interrupt copying using a composite or a two-sided copy mode to occur when the set number of copies is smaller than the maximum number of images which can be formed on said transfer belt; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

6. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

reversing means for reversing a direction in which a recording medium is discharged in order to execute a page-sequential medium discharge mode;

stacking means for refeedably stacking, in a composite copy mode or a two-sided mode, recording media each carrying an image on a first side thereof;

a first control means for forming, when a composite copy mode or a two-sided copy mode is selected and if the set number of copies is smaller than the maximum number of copies which can be formed on said transfer belt, the set number of images of said first side on said transfer belt to execute said composite copy mode or said two-sided copy mode; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

7. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

a first control means for setting up a page-sequential medium discharge mode when a mixed stack of black-and-white documents and color documents are to be reproduced, as desired; and a second control means for selecting a first transport mode for transporting said recording medium to an intermediate stack, and a second transport mode for transporting said recording medium to a discharge tray; wherein said first and second transport modes are selected to be reverse modes when said image processing unit distinguishes that said document has either a black-and-white image on both sides thereof or a color image on both sides, and said first and second transport modes are selected to be non-reverse modes when said image processing unit distinguishes that said document has a black-and-white image on one side thereof and a color image on the other side.

8. An image forming apparatus comprising:

image reading means for selectively reading a document in either one of opposite direction with respect to a leading and a trailing edge of said document;

an image processing unit for automatically distinguishing a black-and-white document and a color document;

writing means for selectively forming either one of a mirror and a non-mirror electrostatic latent image on a photoconductive element;

developing means for developing the latent image formed on said photoconductive element to produce a toner image;

a transfer belt located to face said photoconductive element and to allow a recording medium to pass through between said transfer belt and said photoconductive element;

first transferring means for transferring a mirror toner image from said photoconductive element to a recording medium and a non-mirror toner image from said photoconductive element to said transfer belt;

second transferring means for transferring the toner image from said transfer belt to a recording medium;

reversing means for reversing a direction in which said recording medium should be discharged;

a first control means for setting up a page-sequential medium discharge mode when a mixed stack of black-and-white documents and color documents are to be reproduced, as desired; and a second control means for selecting a first transport mode for transporting said recording medium to an intermediate stack, and a second transport mode for transporting said recording medium to a discharge tray; wherein said first and second transport modes are selected to be reverse modes when said image image processing unit distinguishes that said document has either a black-and-white image on both sides thereof or a color image on both sides, and said first and second transport modes are selected to be non-reverse modes when said image image processing unit distinguishes that said document has a black-and-white image on one side thereof and a color image on the other side.

* * * * *

UNITED STATES PATENT AND TRADEMARK OFFICE

CERTIFICATE OF CORRECTION

PATENT NO. : 5,162,859

DATED : November 10, 1992

INVENTOR(S) : Tatsuo Hirono et al.

It is certified that error appears in the above-identified patent and that said Letters Patent is hereby corrected as shown below:

Title page, item [54] and col. 1, in the title should read; --IMAGE FORMING APPARATUS CAPABLE OF

CREATING DUPLEX MIXED FULL COLOR AND BLACK/WHITE COPIES AND DELIVERING

COPY SETS IN PAGE-SEQUENTIAL ORDER--

Signed and Sealed this

Fifth Day of October, 1993

*Attest:*

Bruce Lehman

BRUCE LEHMAN

*Attesting Officer*

*Commissioner of Patents and Trademarks*